US006267283B1

(12) United States Patent
Vogt

(10) Patent No.: US 6,267,283 B1
(45) Date of Patent: Jul. 31, 2001

(54) STORAGE DEVICE FOR PHOTOGRAPHIC MATERIAL

(75) Inventor: Peter Vogt, Köln (DE)

(73) Assignee: Gretag Imaging, A.G., Regensdorf (CH)

( * ) Notice: Subject to any disclaimer, the term of this patent is extended or adjusted under 35 U.S.C. 154(b) by 0 days.

(21) Appl. No.: 09/396,471

(22) Filed: Sep. 15, 1999

(30) Foreign Application Priority Data

Sep. 15, 1998 (EP) ..... 98117482

(51) Int. Cl.[7] ..... B65H 43/00; B65H 20/30
(52) U.S. Cl. ..... 226/118.3; 226/100; 226/11
(58) Field of Search ..... 226/118.2, 118.3, 226/11, 100

(56) References Cited

U.S. PATENT DOCUMENTS 3,049,308 * 8/1962 Lang ..... 226/118.3
3,051,362 * 8/1962 Shook ..... 226/118.3
3,278,100 * 10/1966 Hornberger ..... 226/118.3
3,414,208 * 12/1968 Butler, Jr. et al. ..... 226/118.2
4,223,822 * 9/1980 Clitheroe ..... 226/118.2
4,793,564 * 12/1988 Hank et al. ..... 226/118.2
5,597,105 1/1997 Keller .

FOREIGN PATENT DOCUMENTS 3534846 4/1987 (DE) .
0 812 791 12/1997 (EP) .

* cited by examiner

*Primary Examiner*—Michael R. Mansen
(74) *Attorney, Agent, or Firm*—Burns, Doane, Swecker & Mathis, LLP

(57) ABSTRACT

A storage device for receiving and giving off a photographic band material. The storage device can be used for the buffering of photographic material and/or as indication or control element, and includes an inlet and an outlet for the photographic material band. A weight member pushes onto the photographic band material between the inlet and the outlet for the tensioning thereof, the height of which is changed during changing of the stored band length by interaction between the band tension and its inherent weight. A change in height of the weight member is coupled with a rotation of a driven member of a direction dependent coupling, the drive member of which is rotated in a free wheeling direction. A detector detects a locking condition of the direction dependent coupling, which occurs during free fall of the weight member, and a controller controls the transport of the band based on the detection.

10 Claims, 1 Drawing Sheet

STORAGE DEVICE FOR PHOTOGRAPHIC MATERIAL

This application claims priority under 35 U.S.C. §§119 and/or 365 to 98 117 482.4 filed in Europe on Sep. 15, 1998; the entire content of which is hereby incorporated by reference.

BACKGROUND OF THE INVENTION

1. Field of the Invention

The present invention relates to a storage device for photographic material, especially photographic paper or film.

2. Background Information

Storage devices for photographic material are used for the buffering of band-shaped photographic material during manufacturing or processing, for example, during photographic paper development or film processing. They are also used for indicating the length of the buffered photographic material band and for the control, for example, of the photographic material transport speed, outside the storage in dependence of the buffered length of the band material. Such displays or controls are known, for example, as dancers or dancer controls.

Conventionally, so-called roller storage devices are used for this storage. In those roller storage devices, a photographic band material meanders around guide rollers and along a transparent path between an inlet and an outlet of the storage. By displacement of the guide rollers relative to one another, the transport path in the storage device is lengthened when the guide rollers move away from one another or shortened when they approach one another. Guide rollers are positioned, for example, in several planes, especially in two planes and the length of the transport path is changed by changing the spacing between the axis of the guide rollers in the different planes. Especially the transport speed of the photographic band material at the storage outlet can be reduced or completely stopped by lengthening the transport path within the storage.

The guide rollers of the lowermost plane normally carry out an up and down movement for change of the transport path length. The lower guide rollers are thereby positioned on a sled and are therefore connected with each other. The sled together with the lower guide rollers serves as a weight member which keeps the photographic material tensioned along its path in the storage by way of its weight, whereby the lower guide rollers upon shortening of the photographic band material are moved upwardly against the weight and by the pull of the photographic material.

If the end of a photographic band material reaches the storage and passes therethrough or if the photographic material band ruptures, a free fall of the lower guide rollers with the sled can occur. In order to avoid this, a guide for the sled must be provided which includes brakes which are activated in such a situation, but otherwise allow a free up and down movement of the sled and the lower guide rollers.

For the threading in of the photographic band material, the lower guide rollers during storage operation are positioned above the upper guide rollers during storage operation so that the photographic band material can run straight between these guide rollers during the threading in. Thus, in order to reach the starting position for the threading in, the sled with the lower guide rollers must be moved up. Lifting devices are provided herefor which operate, for example, with chains, belts or spindles.

A sled for a storage arrangement must therefore be able to assume three operating conditions, namely, first, moving up"(for the threading in), second, braking" (at band rupture or band end), and, third, freely moveable under inherent weight" (during storage operation).

In order that the sled or the lower guide rollers can assume the above-mentioned three different operating conditions, brakes and clutches are provided in the prior art together with costly electrical controls.

SUMMARY OF THE INVENTION

It is now an object of the invention to provide a storage device which allows a free change of the band length in the storage during the operating condition with a photographic band material tensioned by way of a weight member and in the case of and rupture or at the band end, prevents a free fall of the weight member without the requirement of costly electrical controls.

The storage arrangement in accordance with the invention serves the receiving and supply of a photographic band material which is fed into the storage device through an input and supplied therefrom through an output. The photographic material band extending between the input and the output is tensioned by way of a weight member which pushes onto the photographic material band or rests thereon. In this manner, the band is maintained taught when more band is fed in than is removed. If conversely more band is removed than supplied, the weight member is lifted by the pull of the band. The weight member is preferably constructed such that it remains in about the same vertical position so that a change in location of the weight member only coincides with a change in height of the weight member. The weight member is herefor provided, for example, with a guide below which the band slides past the guide with little friction, whereby the guide, because of its inertia, does not or not significantly change its position in the horizontal. Alternatively, the weight member can, for example, have a roller, for example, the guide roller known in the art. This roller rotates preferably freely during transport of the photographic band material and thereby remains in about its horizontal position during transport of the photographic band material. Furthermore, sleds and guides can be provided which maintain the weight member in about a specific horizontal position, but permit a vertical movement of the weight member. Especially, several weights can be connected with each other through these guides or sleds. Several separate weight members can also be provided. However, for reasons of simplicity, only one weight member will be referred to in the following.

The storage device is preferably provided with a drive arrangement in accordance with the invention which allows a change of the height of the weight member or possibly also several weight members, depending on the condition either freely or actively, by way of a direction dependent coupling, also called coaster or free wheel coupling. In a direction dependent coupling or in a coaster, the switching process, i.e., the transition between a locked condition in which the driving member and driven member of the coupling are connected, for example, clamped together, and a free wheel condition in which the drive member and driven member are moveable independent of one another, depends on the direction of the relative rotation movement between the drive member and the driven member. In one direction of the relative movement, it is prevented (locked condition) and in the other direction, it is not (free wheel condition). Coasters of various construction are known, for example, pawl coasters (locking wheels, ratchets) or, for example, free wheel hubs. In the free wheel condition, the weight member can freely change its height, while in the locked condition, a height change, especially a lifting, can be achieved through the direction dependent coupling.

Preferably, the height change of the weight member as it occurs, for example, during the storage operation, is coupled with the rotation movement of the drive member through a mechanical linkage, for example, a belt, in such a way that a height change of the weight results in a rotation of the driven member and conversely a rotation of the driven member in a height change of the weight.

Preferably, the drive member is rotated in free wheel direction, especially during the normal storage operation in which the storage functions as a buffer. It preferably rotates continuously during the storage operation and especially preferably with a preselected, especially constant speed.

By rotation of the drive member in free wheeling direction, a free movement of the weight member not only upward but also downward is possible. However, if the sink speed of the weight member exceeds a certain threshold value in which the driven member wants to rotate at a higher speed and in the same direction as the drive member, the direction dependent coupling transfers from the free wheel condition into the locking condition. In this manner, it is prevented that the driven member rotates at an excessive speed corresponding to the free fall of the weight member upon rupture of the band or at the band end. The weight member, even at the band end or upon rupturing of the band, can only sink with the maximum speed set by the rotation of the drive member.

In accordance with the invention, the sinking movement at the band end or upon band rupture can occur, for example, until a stop is reached at which the drive is, for example, stopped and/or, for example, it is arranged that the at least one weight is brought into the threading in position.

In order to keep the sink speed upon band rupture or at the band end as low as possible, the drive member is preferably rotated at a preselected speed which is slightly higher or the same as the marginal speed which results from the maximum band receiving speed of the storage and the therewith coupled rotation of the driven member. The therefrom resulting maximum speed of the driven member during storage operation is thereby preferably smaller or the same as the preselected speed with which the drive member is rotated in the free wheel direction. The maximum band receiving speed which is demanded from the storage depends on its field of use. Typically, it results when no more photographic band material is supplied therefrom and photographic band material is fed into the storage at a maximum speed. At any rate, the maximum band receiving speed determines a maximum sink speed of the weight which is again coupled with a maximum rotation speed of the driven member. The drive member should therefore be rotated with a rotation speed so that in this condition the direction dependent coupling is at least still in a free wheeling condition.

A drive is preferably provided for the driving of the drive member which, in the switchedoff condition, prevents a rotation of the drive member. The drive therefore includes, for example, a brake or is self-stopping (for example, by use of a worm drive). The weight is thereby preferably held at a desired height without having to supply energy to the drive after lifting of the weight by rotation of the drive member in driving direction or locking direction, especially for the threading in after reaching of the end position.

If a preselected lowest point is reached, the drive is preferably switched off, whereby a further sinking of the weight is prevented. This is especially then advantageous when the band end is reached or the band ruptures.

Before the lowest point is reached, a continuous slowing down can be achieved by a control which reduces the speed with which the drive member is rotated. This can especially then be carried out when the band end is reached or the band ruptures.

In accordance with the invention, a free fall of the at least one weight can be detected by detection of the locking condition of the free wheel coupling. During the storage operation upon continuous rotation of the drive member, the coupling is in the free wheeling condition and only switches into the locking condition upon a free fall of the weight. This detection can be further used for the control and especially for producing a warning signal or for controlling the band transport, for example, for the stopping of the band transport. By detecting in parallel whether a band end has reached the storage, it can be determined whether the free fall of the weight is caused by a normal band end or by a rupturing of the photographic material band. Depending thereon, different control consequences can be drawn, for example, the band can be stopped upon rupturing, whereby when the band ends the transport continues unimpeded and only a warning signal is given.

BRIEF DESCRIPTION OF THE DRAWINGS

A preferred embodiment is described in the following with reference to the attached Figures. Further advantageous features of the invention are thereby disclosed.

DETAILED DESCRIPTION OF THE PREFERRED EMBODIMENTS

Figure 1:
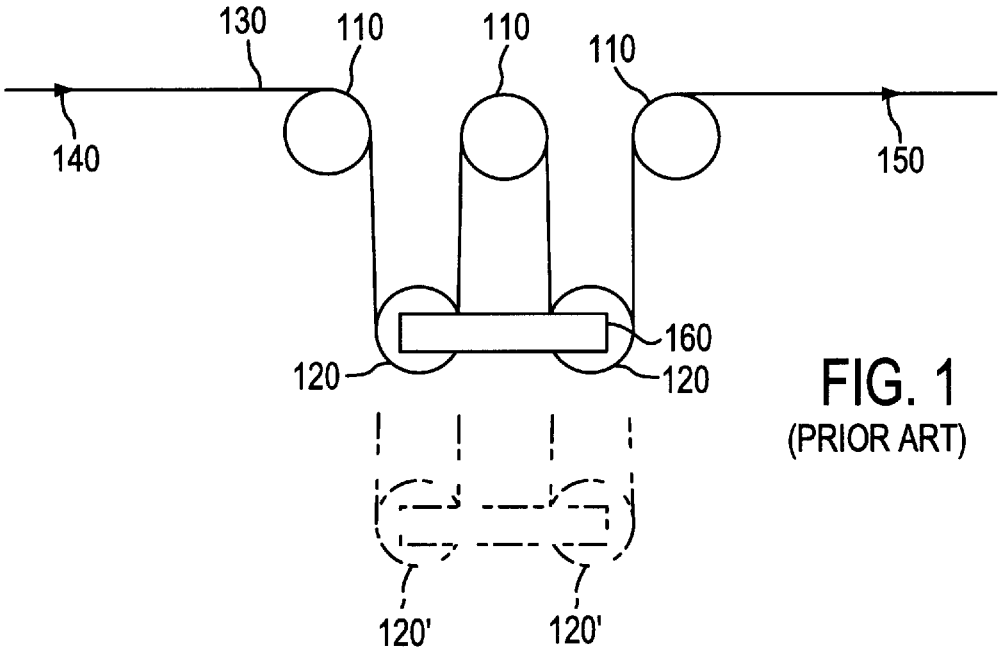
FIG. 1 (PRIOR ART)
FIG. 1 shows a conventional roller storage device.

FIG. 1 schematically illustrates a roller storage device which includes three upper rollers 110 and two lower rollers 120. A band 130 meanders between the upper and lower rollers from an inlet 140 to an outlet 150 (respectively schematically illustrated as arrowhead). If less band material is removed at the outlet 150 than is fed in at the inlet 140, the length of the band 130 increases as is indicated in broken lines and the lower guide rollers 120 are displaced into the positions 120'. The lower guide rollers are connected by a sled 160.

Apart from its storage function, the storage in accordance with the invention can also be used as display and/or control element. The height of the lower rollers 120 indicates how much band is still available in the storage. The height of the rollers can thereby be coupled with a control which, for example, controls the speed of the band material at the inlet or the outlet. If it is the main purpose of the storage to function as display or control element, preferably only a single lower guide roller functions as the moveable element.

Figure 2:
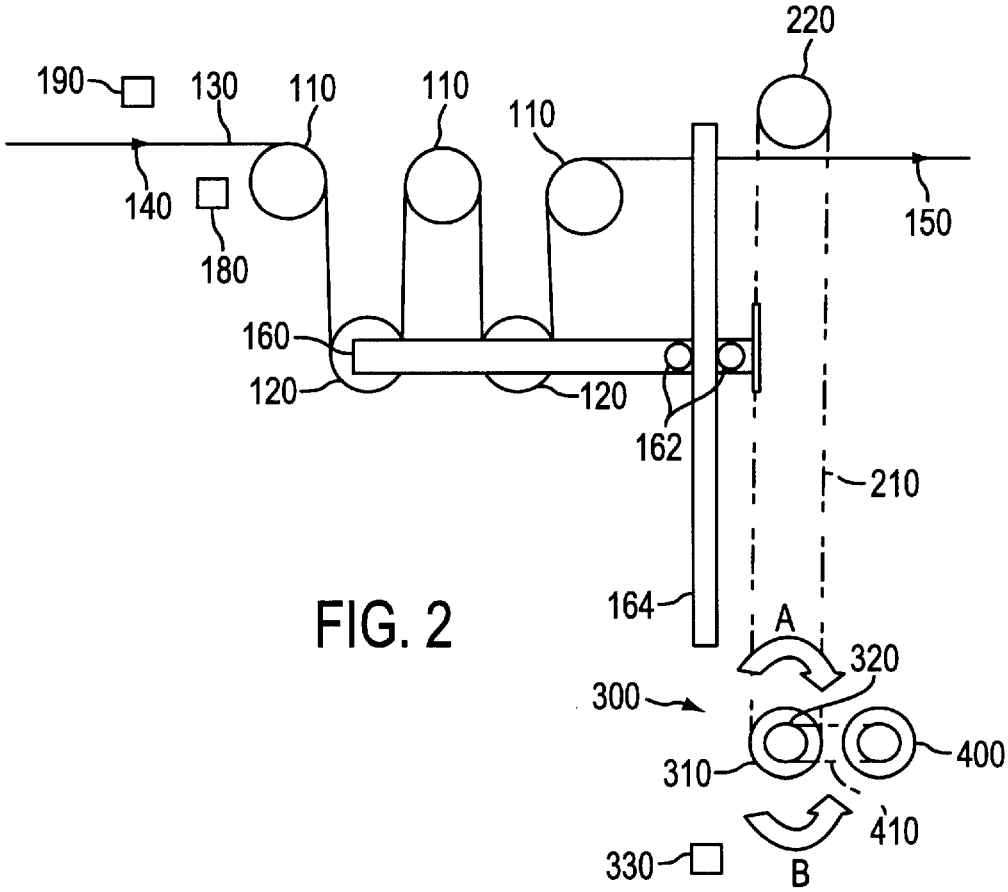
FIG. 2 shows a roller storage device with the drive in accordance with the invention.

FIG. 2 shows a storage in accordance with the invention with the drive in accordance with the invention. The same elements as in FIG. 1 are thereby referred to with the same reference numbers so that their description is now obviated.

The sled 160 is guided during its upwards or downwards movement by way of a roller support 162 and a guide rod 164. The sled 160 is affixed to a traction means 210, such as, for example, a belt. The traction means 210 extends around a guide disk or a guide roller 220 and over the driven member 310 of the coaster 300 (also called a direction dependent coupling or a free wheel coupling, as described above). It is also tensioned between the guide disk 220 and the coaster 300.

When the lower guide rollers 120 are lifted, the driven member of the coaster rotates in the direction indicated by the double arrow A. When the lower guide rollers are lowered, the driven member rotates in the direction indicated by the double arrow B.

For the lifting of the guide rollers, the drive member 320 of the coaster 300 is rotated in drive direction by way of a drive 400, for example, by way of a chain or belt 410, i.e., in direction of the double arrow A. The coaster 300 is thereby in the locked condition so that the driven member 310 rotates together with the drive member 320 in the direction A and lifts the lower guide rollers.

During the storage operation, the guide rollers are lifted and lowered together with a sled upon shortening or lengthening of the freely running band 130.

A lifting of the lower guide rollers during the storage operation is principally not prevented by the coaster, since the driven member rotates relative to the drive member in the direction A during lifting of the guide rollers and the free wheel coupling 300 is thereby in the free wheel condition. A lowering of the lower guide rollers causes a rotation of the driven member in direction B. If the drive member would not rotate in free wheeling direction, this would cause the free wheel coupling to be in a locked condition and a sinking of the guide rollers would thereby be prevented. Therefore, in order to enable a free sinking of the guide rollers in the normal storage operation of the storage, the drive member is rotated in accordance with the invention with a preselected rotation speed in direction B. This preselected rotation speed is adjusted such that it is faster than the rotation speed of the driven member 310 in direction B which is maximally possible during the normal storage operation. In this manner, the driven member always rotates in direction A relative to the drive member during the normal storage operation so that a free movement of the sled upwards and downwards can take place.

The maximum rotation speed of the driven member in direction B in the normal operating condition results from the maximum speed with which the photographic band material 130 is fed into the storage at the input 140 when no photographic band material is removed at the output 150. A certain maximum sink speed of the lower guide rollers and therefore the sled 160 results in that condition which again is coupled with a maximum rotation speed of the driven member in direction B.

In the case of band rupture or if the end of the band is reached, the sled 160 with the lower guide rollers 120 falls in a free fall downward until the free fall speed reaches a marginal speed which is preset by the rotation speed of the drive member 320 in direction B. The rotation speed of the drive member in direction B is therefore adjusted for the storage operation such that it corresponds to the maximum sink speed during storage operation or is slightly thereabove. A free fall of the sled can be limited in this manner to the maximum sink speed during storage condition without the requirement for a special electronic control. Damage to the sled and the lower guide rollers, i.e., the weight member, can thereby be avoided. When a lower stop (not illustrated) is reached, the drive is switched off.

In addition, a free fall of the at least one weight can be detected by detection of the locking condition of the free wheel coupling using a detector (e.g., detector 330). During the storage operation upon continuous rotation of the drive member, the coupling is in the free wheeling condition and only switches into the locking condition upon a free fall of the weight. This detection can be further used by a controller (e.g., controller 180) for the control and especially for producing a warning signal or for controlling the band transport, for example, for the stopping of the band transport. By using a detector (e.g., end detector 190) to detect in parallel whether a band end has reached the storage, it can be determined whether the free fall of the weight is caused by a normal band end or by a rupturing of the photographic material band. Depending thereon, different control consequences can be drawn, for example, the band can be stopped upon rupturing, whereby when the band ends the transport continues unimpeded and only a warning signal is given.

The height of the weight member or the sled may be used for indication or control purpose.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all change that come within the meaning and range and equivalence thereof are intened to be embraced therein.

What is claimed is:

1. Storage device for buffering photographic material by receiving and giving off a photographic material band, comprising:

a storage inlet and a storage outlet for respectively receiving and giving off the photographic material band;

a weight member for pushing on the photographic material band between the inlet and the outlet for tensioning thereof, a height of the weight member changing upon change of a stored band length by interaction of a band tension and an inherent weight of the weight member;

a direction dependent coupling having a driven member and a drive member, the driven member and the drive member being in at least one of a locked condition, in which the movement of the drive member is coupled with the movement of the driven member, and an unlocked condition, in which the drive member and the driven member are moveable independently of one another, wherein the locked and unlocked condition depends on a direction of relative rotation movement between the drive member and the driven member; and a drive device which rotates the drive member, wherein a height change of the weight member is coupled with a rotation of the driven member, wherein the drive member is rotated by the drive device in a direction for unlocking the driven member and the drive member, and wherein a detector is operable to detect a locked condition and a controller is operable to control transport of the band based on the result of the detection.

2. Storage device according to claim 1, wherein the rotation of the drive member in the direction for unlocking takes place at a preselected speed which is at least equal to a marginal speed, said weight member changing its height depending on a speed of photographic material take up, said height change being coupled with the rotation of the driven member, said marginal speed being selected such that the direction dependent coupling remains unlocked despite the rotation of the driven member at a preselected maximum photographic material take up speed so that a sinking of the weight member caused by the take up of photographic material at the maximum speed is not stopped by a locking of the directional coupling.

3. Storage device according to claim 1, wherein the drive device rotates the drive member in a drive direction and which prevents a rotation of the drive member in a switched off condition.

4. Storage device according to claim 3, wherein the drive device stops the driving of the drive member in the direction for unlocking when the weight member reaches a preselected lowest point.

5. Storage device according to claim 1, wherein the drive device reduces the rotation speed of the drive member when, during rotation of the drive member in the direction for unlocking and feeding of a photographic material band into the storage, an exceeding of at least one of a maximum sink speed and a locking of the direction dependent coupling is detected.

6. Storage device according to claim 1, wherein at least one of a warning signal is produced and transport of the photographic band material is stopped when, during rotation of the drive member in the direction for unlocking, an exceeding of at least one of a maximum sink speed and a locking of the direction dependent coupling is detected and when it is not detected, that a photographic material band end has entered the storage.

7. Storage device according to claim 1, wherein the weight member includes:

at least one guide roller which freely rotates during photographic material band transport but does not move with the photographic material band in a horizontal direction, and on which the photographic material band runs.

8. Storage device according to claim 7, wherein the weight member includes:

several guide rollers, and a sled which connects the guide rollers.

9. Storage device according to claim 1, comprising a height changing linkage which connects the weight member with the driven member and which translates rotation of the driven member, depending on rotation direction, into a lowering or lifting of the weight member, and conversely translates a lifting or lowering of the weight member into a corresponding rotation of the driven member.

10. Storage device according to claim 1, wherein a guide is provided for the weight member which guides the weight member during its upward and downward movement.

* * * * *